US005297467A

United States Patent [19]

Hoshino

[11] Patent Number: 5,297,467

[45] Date of Patent: Mar. 29, 1994

[54] BEATER AMPLITUDE ADJUSTMENT MECHANISM FOR A DRUM PEDAL

[75] Inventor: Yoshiki Hoshino, Asahi, Japan

[73] Assignee: Hoshino Gakki Co., Ltd., Japan

[21] Appl. No.: 975,796

[22] Filed: Nov. 13, 1992

[30] Foreign Application Priority Data

Jun. 19, 1992 [JP] Japan ..... 4-049047

[51] Int. Cl.[5] ..... G10D 13/00

[52] U.S. Cl. ..... 84/422.1

[58] Field of Search ..... 84/422.1, 422.2

[56] References Cited

U.S. PATENT DOCUMENTS 3,797,356 3/1974 Duffy et al. ..... 84/422.1
3,930,431 1/1976 Magadini ..... 84/422.1
4,691,613 9/1987 Jacobson ..... 84/422.1
5,204,485 4/1993 Lombardi ..... 84/422.1

*Primary Examiner*—Michael L. Gellner
*Assistant Examiner*—Cassandra Spyrou
*Attorney, Agent, or Firm*—Ostrolenk, Faber, Gerb & Soffen

[57] ABSTRACT

To adjust the amplitude of the swing of a drum beater, the beater is supported on a clamp which is clampable at a selected rotary position around a clampable part on a rotary shaft. That clampable part is connected with a sprocket wheel. A pedal is connected by a chain with the sprocket wheel to rotate the wheel to rotate the shaft to beat the drum head. Adjustment of the clamp and the beater around the clampable part sets the beater amplitude.

9 Claims, 7 Drawing Sheets

BEATER AMPLITUDE ADJUSTMENT MECHANISM FOR A DRUM PEDAL

BACKGROUND OF THE INVENTION

The present invention relates to a beater amplitude adjustment mechanism for a drum beater pedal. A pedal operated drum beater includes a beater with a beater head that is swung from a rest position to bang a drum head. The amplitude of that swing is determined by the distance of the beater head from the drum head before the beater head swings. The invention concerns setting the starting point of the swing of the beater head.

FIGS. 5 through 7 show a conventional beater mechanism for beating the head of bass drum. A drum pedal device 90 has a base 91. Supports 92 are erected on both sides of the base 91. A horizontal beater rotary shaft 94 is freely rotatable in ball bearings 93 provided toward the tops of the supports 92.

Approximately at the center of the rotary shaft 94, there are a beater installation member 110 and next to it a wheel 120 which both rotate integrally with each other. The beater 115 is comprised of a shaft with a beater head at its end, and that shaft is fixed to the beater installation member 110 by an attachment screw.

The wheel 120 comprises a sprocket or at least a partial sprocket on its outer periphery. One end of the chain is fixed to the wheel 120 and trained on the sprocket teeth. The other end of the chain 121 is connected to the tip of a foot pedal 95. As the foot pedal 92 is stepped on by a performer, as indicated by arrow A in FIG. 5, the chain 121 is pulled down. This rotates the wheel 120 in turn rotates the beater installation member 110 which causes the head of the beater 115 to strike the drum surface D.

A cam 100 is fixed at the end of the rotary shaft 94 by a screw 101. As shown in FIG. 5, the cam 100 has approximately the shape of a fan. In FIG. 7, a bearing hole 102 formed at the pivot of the fan shaped cam receives the rotary shaft 94. A plurality of roller installation holes 103 are provided at spaced intervals around the periphery of the cam. A roller installation bolt 104 is screwed into one of the roller installation holes 103. The hole 103 selected to receive the bolt 104 determines the initial rotary orientation of the cam and the start of the swing of the beater 115, as described below. A roller 105 is inserted into the roller installation bolt 104. The roller 105 supports a hanging ring 106.

The top of a tension spring 107 is supported on the tip of the hanging ring 106. The lower end of the spring 107 is supported to a lower bracket 109 which is outside the support 92. The force of the spring 107 pulls down on the ring 106 and the bolt 104 and automatically returns the beater 115 to its original position away from the drum head. The hole 103 selected determines the rotative orientation of the cam 100, the shaft 94 and the beater 115 at the start position. An adjusting bolt 108 adjusts the tension of the spring 107. A known clamp 130 holds the base on the drum hoop.

The amplitude of the swing of the beater 115 is established by tilting the incline of the beater installation member 110, thereby changing the distance between the head of the beater 115 and the drum surface D. This is done by selecting one of the positions defined by the plurality of installation holes 103 in the cam 100 for changing the incline of the cam.

The conventional mechanism determines the amplitude of swing of the beater stepwise by the position based on the separated roller installation holes 103. This makes difficult a delicate amplitude adjustment according to the desire or performance style of the performer. In addition, adjustment of the beater amplitude position has been troublesome, since it has been necessary to remove the roller installation bolt 104 each time the spring 107 is replaced.

In view of the above-described situation, the present inventor proposed, in Japanese Utility Model Application Hei 3-38099, a beater amplitude adjusting mechanism for a drum pedal, wherein a cam is fixed at the end of a beater rotary shaft which is freely rotatably supported on a support. The spring is adjusted through the roller on the cam through an arc-shaped roller installation groove in the cam having the beater rotary shaft as the center, which adjustably fixes the roller.

The above design enables creation of delicate sound expressions, because the amplitude of the beater swing can be adjusted over a continuous range and without the presence of a step by changing the rotary position of the beater rotary shaft as compared with the spring by employing a cam.

With either of the aforementioned beater amplitude adjust mechanism because both of the beater installation member and the wheel are fixed to the beater rotary shaft, the wheel on which the chain is trained rotates as the rotary position of the beater rotary shaft is changed for adjusting beater amplitude. The rotation of the wheel causes the height position of the pedal plate to also change, thereby creating inconvenience to the performer.

SUMMARY OF THE INVENTION

The object of the invention is to overcome the problems with conventional devices.

Another object is to provide a beater amplitude adjustment mechanism for the drum pedal which is capable of adjusting the amplitude of the swing of the beater and which is further capable of easily making delicate adjustments without changing the height position of the pedal plate.

In a beater amplitude adjustment mechanism for a drum pedal, there is a clampable and unclampable clamp on the beater rotary shaft which is freely rotatably positioned on a support on the rotary shaft and then clampable at the selected rotary position. The drum beater installation member is installed on the clamp to thereby be freely rotatably adjustable, thereby adjusting the amplitude angle of the beater against the drum.

Other objects and features of the invention are explained below with reference to the drawings.

DESCRIPTION OF THE PREFERRED EMBODIMENT

Figure 1:
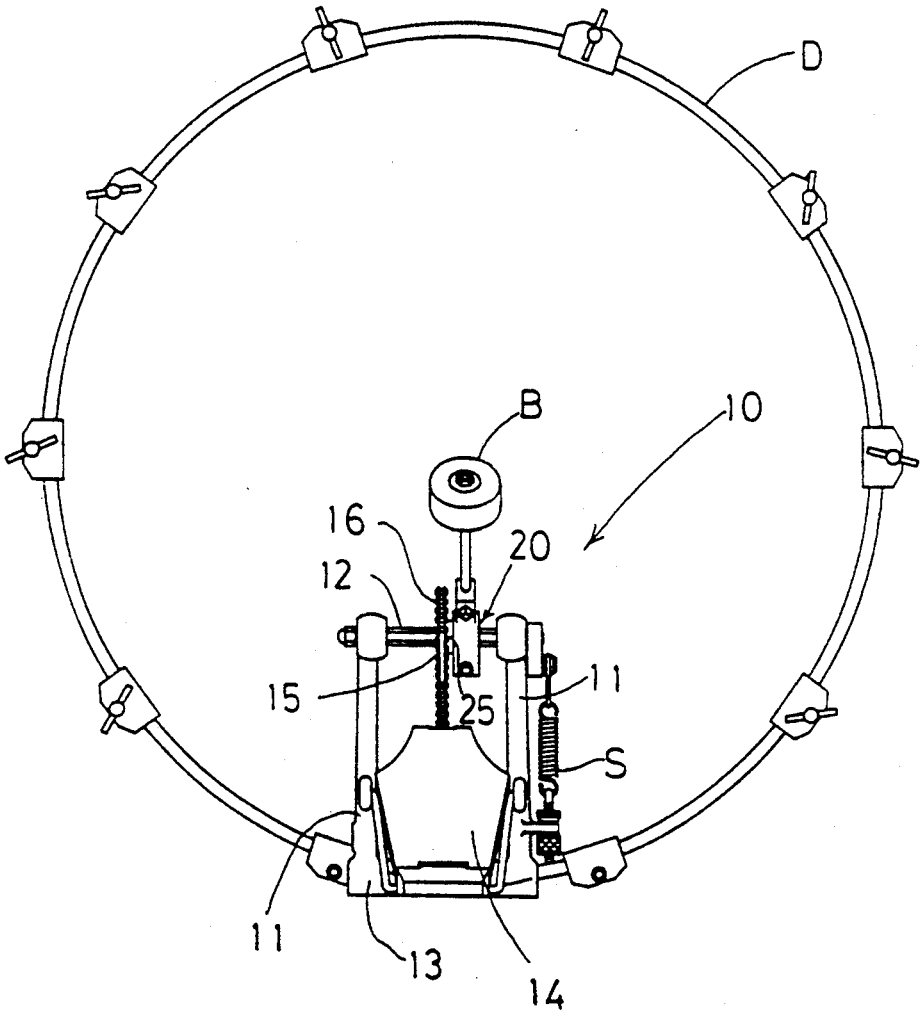
FIG. 1 is a front view of a drum pedal with a beater amplitude adjustment mechanism of the invention installed.
Figure 2:
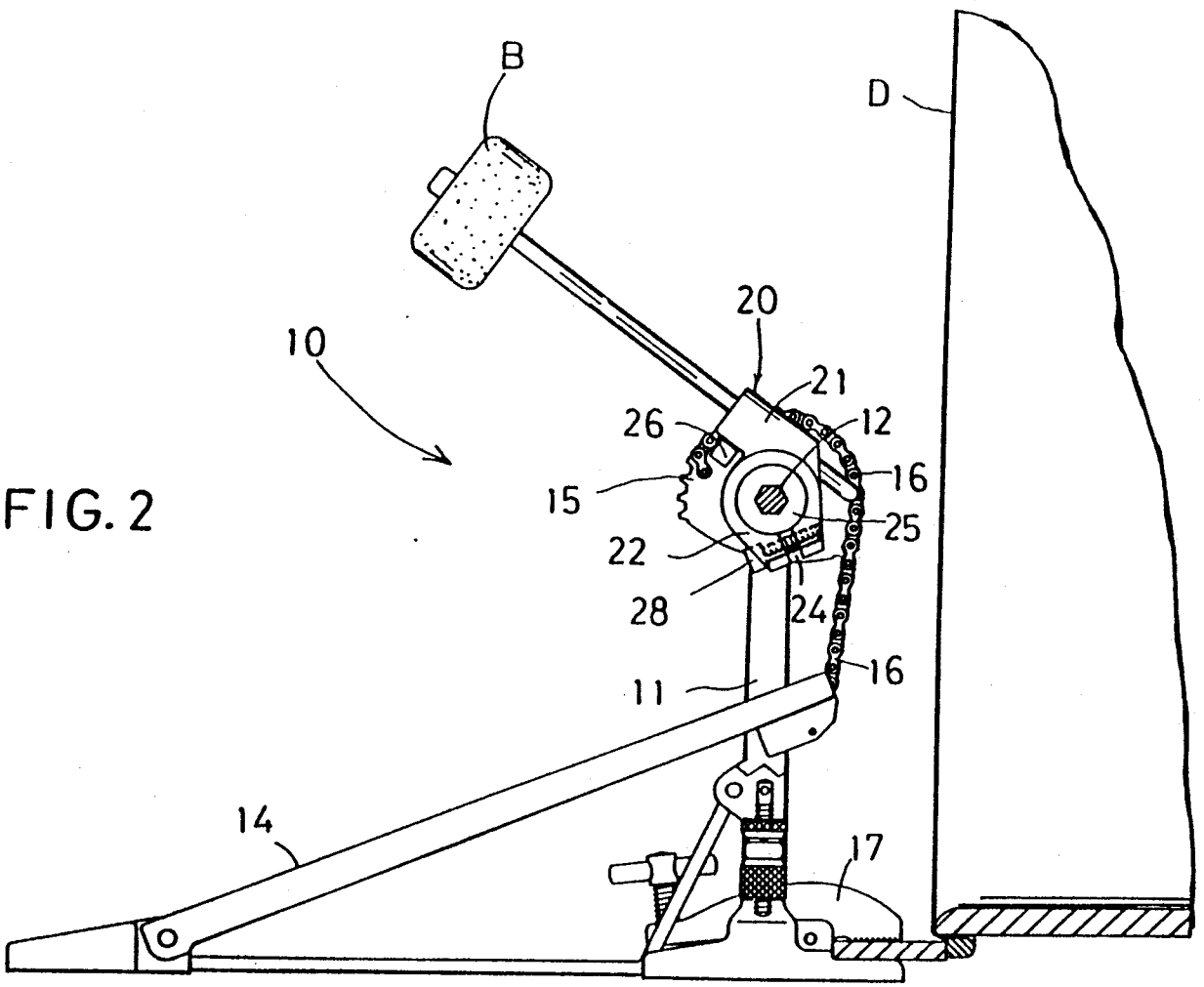
FIG. 2 is a side view of same mechanism.
Figure 3:
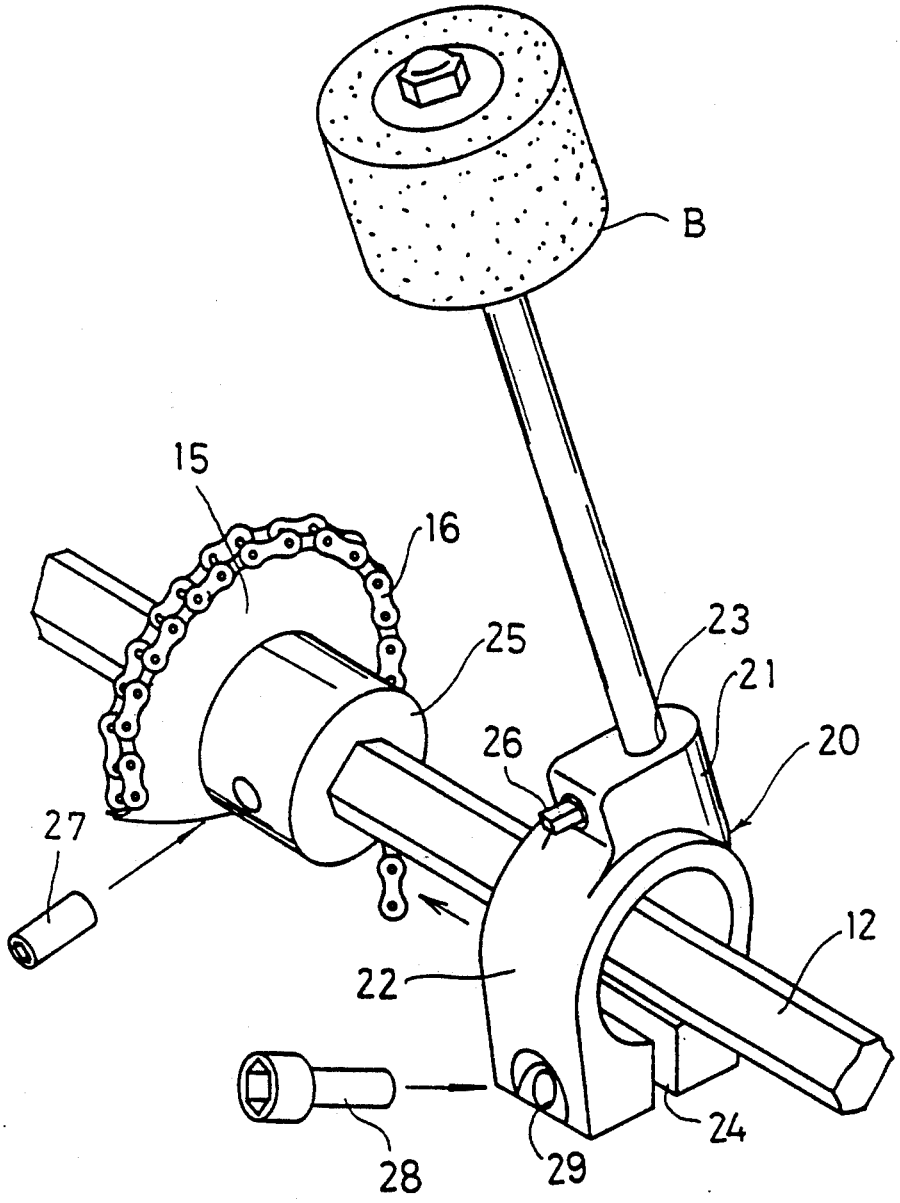
FIG. 3 is an oblique view of essential parts of the amplitude adjustment mechanism.

As shown in FIGS. 1 and 2, a beater amplitude adjustment mechanism for a drum pedal according to the invention comprises a beater installation member 20 which is installed on the beater rotary shaft 12 of a drum pedal 10 through being clamped onto an installation part 25 on the shaft 12.

The drum pedal has a base 13. A hoop clamp 17 on the base 13 clamps to the hoop around the drum head of the drum D. There are upstanding supports which are erected on both sides of the base 13. The beater rotary shaft 12 is freely rotatably supported in ball bearings on the supports 11.

A pedal plate 14 is pivoted at its rear end to the base 13. The front end of the plate 14 is connected to a wheel 15 through connecting means in the form of a flexible connector, like a strap, but preferably in the form of a chain 16. One end of the chain is connected at one end to the free swinging end of the pedal plate 14. The other end of the chain is attached to the wheel 15 and the chain is entrained over the sprocket teeth on the periphery of the wheel. The wheel 15 is on the shaft 12. The beater B is swingably supported, as described below. A spring S returns the beater to the out of contact start position.

Approximately at the center of the shaft 12, there is a clamping part 25 which has an opening which is shaped to the profile of the shaft 12 or is clampable to the shaft so as to rotate therewith and which has an external circular periphery of a diameter which is somewhat greater than the diameter of the beater rotary shaft 12. The clamping part 25 is fixed to the beater rotary shaft 12 by a fixing bolt 27 so that the clamping part is positioned along and rotates along with rotation of the beater rotary shaft 12. The wheel 15 and the clamping part 25 both rotate with, actually swing back and forth with the shaft 12. The clamping part 25 may be formed integrally with the wheel 15.

The beater installation member 20 comprises a beater support 21 which is carried on a beater rotary shaft installation part 22. The installation member 20 is installed freely adjustably on the clamping part 25.

The beater rotary shaft installation part 22 is formed in an approximately tubular shape with an open interior 30 and with one side open to define a split ring. The tubular clamping part 25 extends into the opening 30 in the installation part 22 in a manner permitting rotative adjustment between the parts 22 and 25. At the opening 30, the installation part at the opening 24 is clamped by a beater installation clamping bolt 28 to clamp the part 22 around the clamping part 25.

Figure 4:
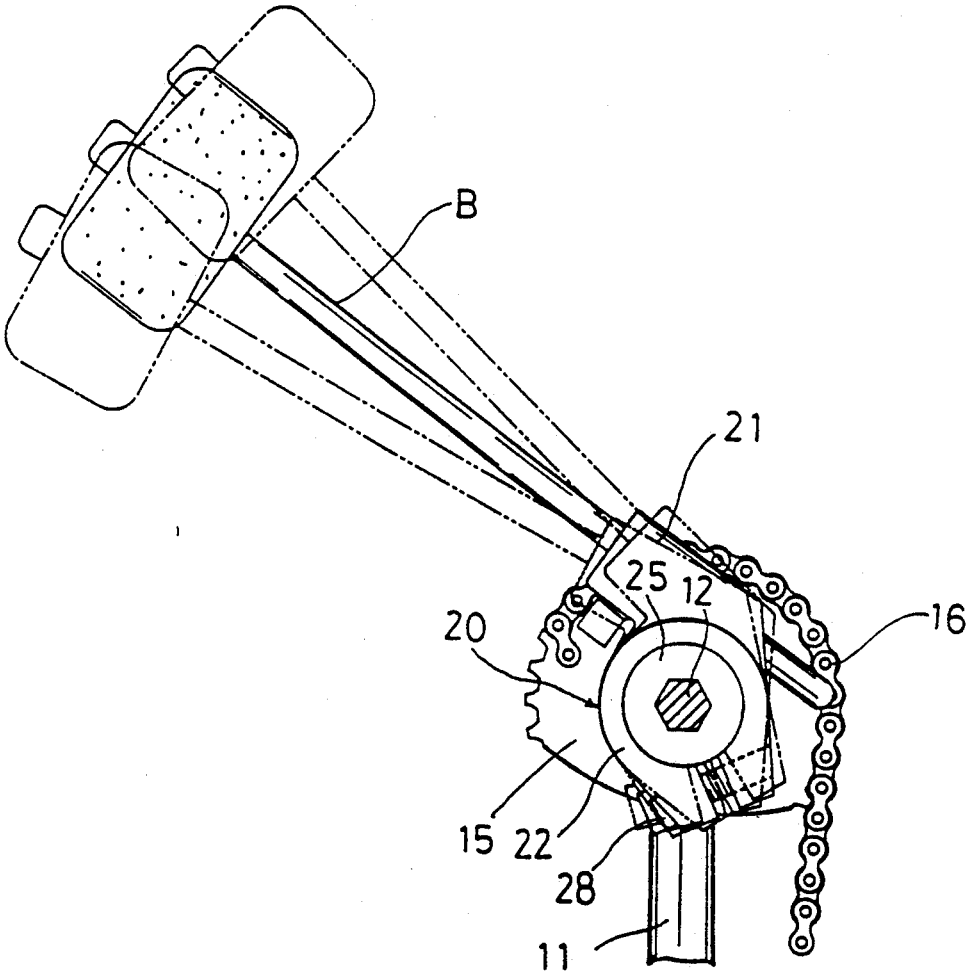
FIG. 4 is a side view showing those essential parts of the mechanism in action.
Figure 5:
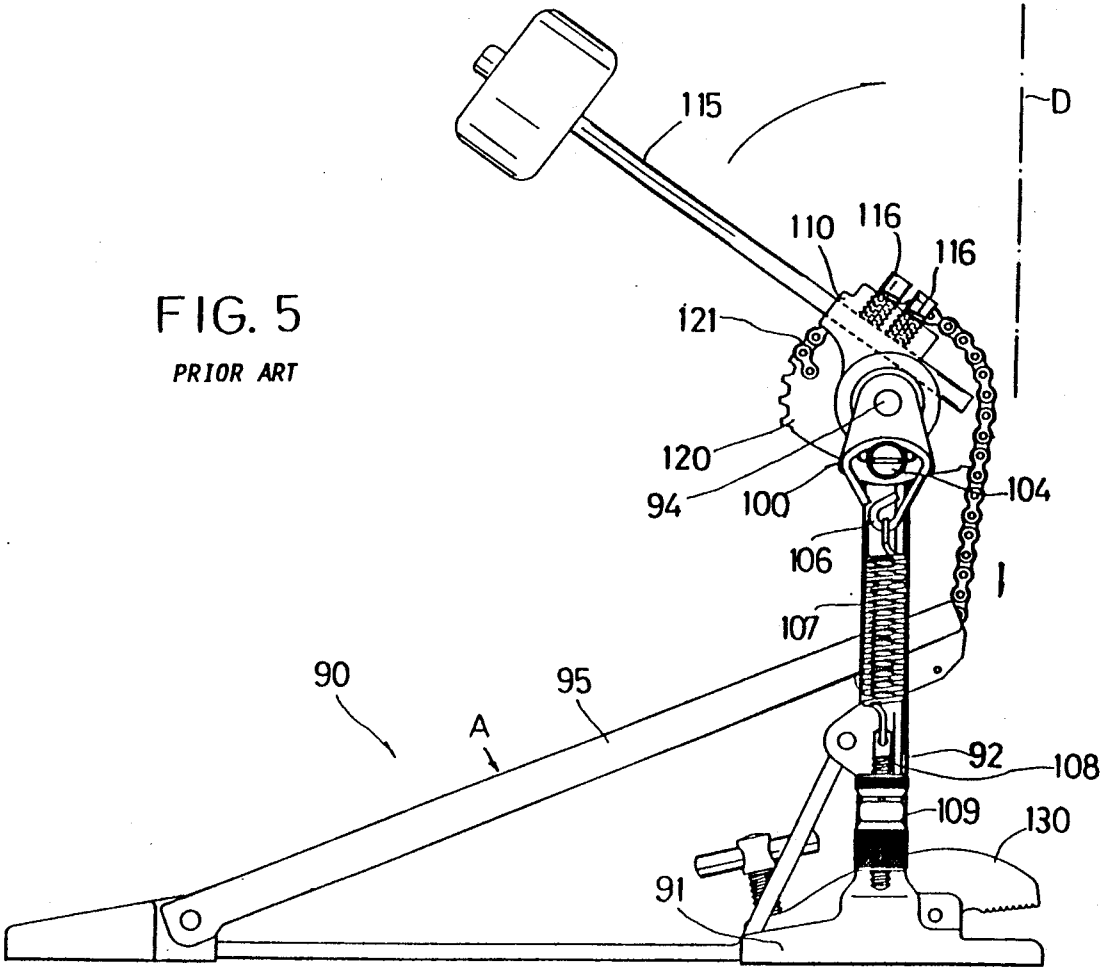
FIG. 5 PRIOR ART
FIG. 5 is a side view of a conventional beater amplitude adjustment mechanism for a drum pedal.
Figure 6:
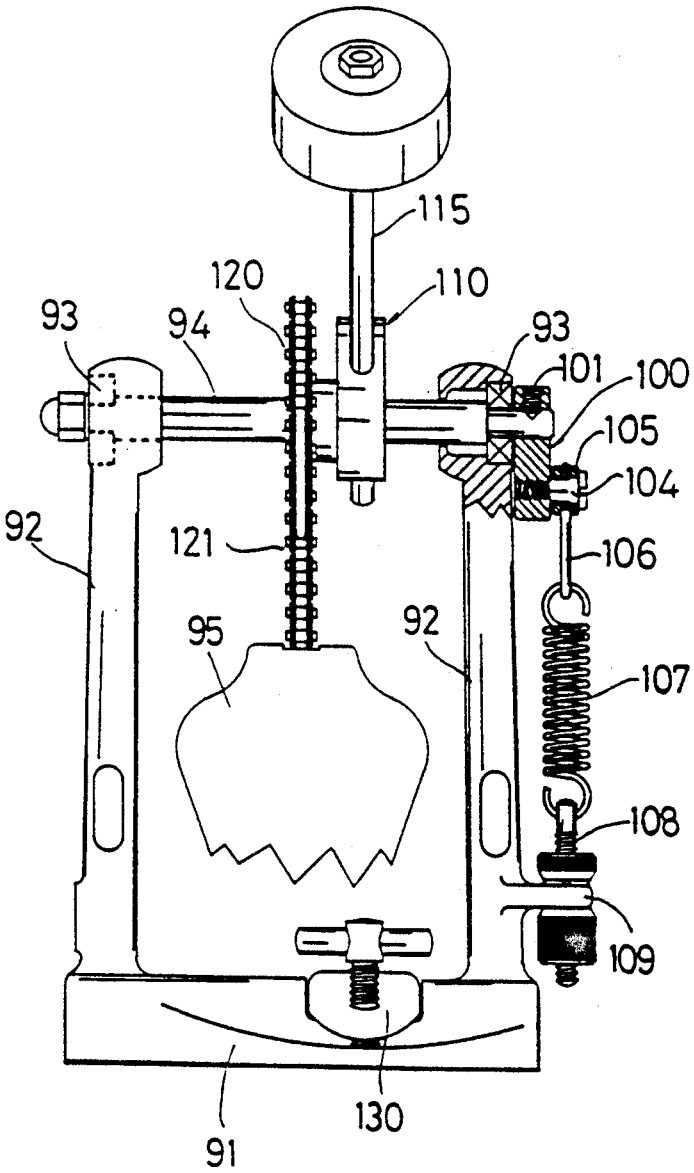
FIG. 6 PRIOR ART
FIG. 6 is a front view of that mechanism, with a part shown in a cross section.
Figure 7:
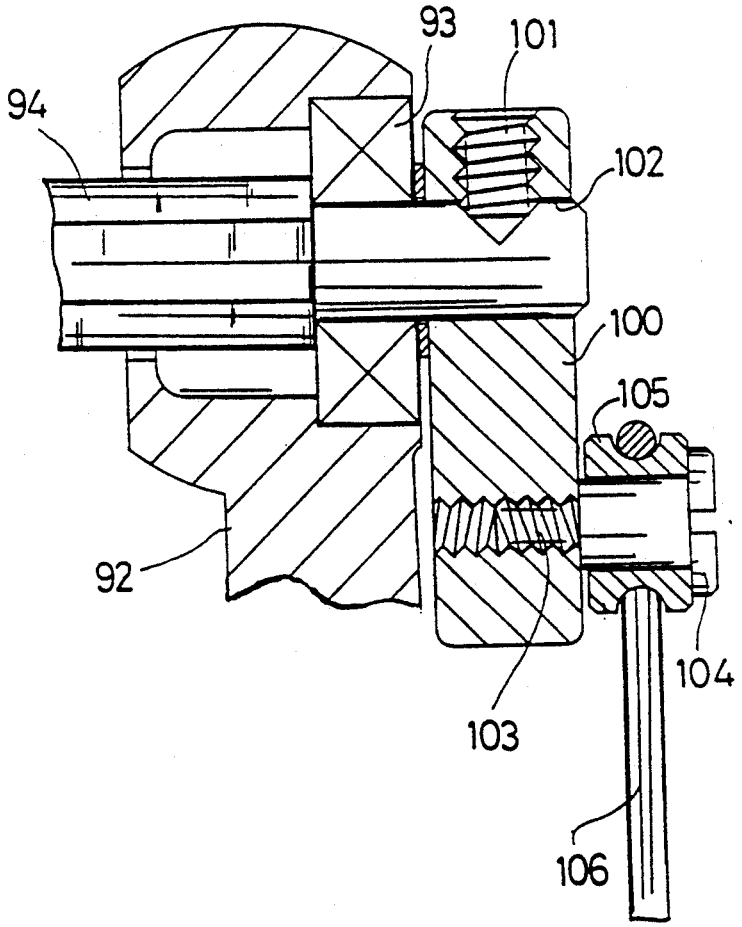
FIG. 7 PRIOR ART
FIG. 7 is an expanded cross section of its essential part.

As shown in FIG. 4, the beater installation member 20 is rotatable in it angular orientation around the clamping part 25 that has been formed on the beater rotary shaft 12 without changing the rotary positions of the rotary shaft 12 or of the wheel 15. This makes it possible to fix the beater B at a desired amplitude distance or spacing away from the drum head, while a desired height position of the pedal 14 is maintained.

The clamping part 25 is attached on the beater rotary shaft 12 which is supported freely rotatably on the support 11. The beater installation member 20 is freely rotatably and adjustably installed on the clamping part 25 and then is fixed there, thereby adjusting the amplitude angle between the drum D and the beater B.

The beater amplitude adjustment mechanism for a drum pedal enables adjustment of the amplitude of only the beater to an angle desired by the performer without changing the height of the pedal plate. Since the adjustment can be carried out by rotating the installation member which is supported on the clamping part, a delicate adjustment can be carried out freely.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. Apparatus for enabling adjustment of the amplitude of swing of a drum beater with respect to a drum head, the apparatus comprising:

a support; a shaft supported by the support and rotatable around the axis of the shaft;

a drum beater comprising a beater head and means for supporting the beater head, the beater head support means comprising a clamp which is clampable on the shaft to secure the clamp and the beater head at a selected rotation orientation around the shaft and which is unclampable for enabling resetting the rotation orientation of the beater head support means;

a beater operating pedal operable between an operating position to which the pedal is operated by the operator and a return position;

connecting means connecting the pedal to the shaft such that movement of the pedal between the operating and return positions rotates the shaft and through the clamp, rotates the beater head toward and away from the drum head for beating the drum head;

a support on the shaft for the connecting means, the connecting means from the pedal being connected with the connecting means support, such that moving the connecting means by the pedal moves the connecting means support on the shaft for rotating the shaft;

the connecting means support having an extended portion, and the clamp having an opening therein which receives the portion of the connecting means support so that the clamp may be rotatable to selected rotative orientations with respect to the shaft before the clamp is clamped to the portion of the connecting means support.

2. The drum head beater assembly of claim 1, wherein the connecting means support is fixed on the shaft to rotate with the shaft while the clamp in the unclamped condition is rotatable in orientation around the shaft.

3. The drum head beater assembly of claim 4, wherein the connecting means support has a portion which extends to the clamp and the clamp being clampable to the shaft through being clamped on the portion of the connecting means support.

4. The drum head beater assembly of claim 3, wherein the portion of the connecting means support received by the clamp is circular in shape and the clamp has a circular opening which receives the connecting portion of the connecting means support so that the clamp may be rotatable to selective rotatable orientations with respect to the shaft before the clamp is clamped to the portion of the connecting means support.

5. The drum head beater assembly of claim 3, further comprising a spring for returning the pedal to the return position and thereby returning the connecting means and the beater head to the return position with the beater head away from the drum head.

6. The drum head beater assembly of claim 3, wherein the clamp is a split ring clamp and is clampable on the portion of the connecting means support on the shaft.

7. The drum head beater assembly of claim 3, wherein the beater head comprises a beater body for beating against the drum head and comprises a beater head shaft between the clamp and the beater head, whereby the beater head is swung by the beater head shaft as the clamp rotates with the rotatable shaft on the support.

8. The drum head beater assembly of claim 1, wherein the connecting means support on the shaft comprises a wheel and the connecting means comprises a flexible connector connected to the pedal and also partially wrapping the wheel, whereby operation of the pedal moves the flexible connector to rotate the wheel for rotating the shaft between the positions of the shaft.

9. The drum head beater assembly of claim 8, wherein the connecting means comprises a chain and the wheel has a periphery with a sprocket defined on the periphery on which the chain is entrained for movement of the pedal through the chain to move the wheel to rotate the shaft.

* * * * *